US007046224B2

(12) United States Patent
Monomohshi

(10) Patent No.: US 7,046,224 B2
(45) Date of Patent: May 16, 2006

(54) DISPLAY DEVICE DRIVER, DISPLAY DEVICE AND DRIVING METHOD THEREOF

(75) Inventor: Masahiko Monomohshi, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 392 days.

(21) Appl. No.: 10/410,267

(22) Filed: Apr. 10, 2003

(65) Prior Publication Data

US 2003/0201962 A1 Oct. 30, 2003

(30) Foreign Application Priority Data

Apr. 10, 2002 (JP) ..... 2002-108546

(51) Int. Cl.
*G09G 3/36* (2006.01)

(52) U.S. Cl. ..... 345/89; 345/690

(58) Field of Classification Search ..... 345/98, 345/100, 690, 89

See application file for complete search history.

(56) References Cited

U.S. PATENT DOCUMENTS

| | | | | |
|---|---|---|---|---|
| 6,570,560 | B1 * | 5/2003 | Hashimoto | 345/211 |
| 6,753,880 | B1 * | 6/2004 | Kudo et al. | 345/690 |
| 2002/0039090 | A1 | 4/2002 | Saito et al. | |
| 2002/0158882 | A1 * | 10/2002 | Liaw et al. | 345/589 |

* cited by examiner

*Primary Examiner*—Sumati Lefkowitz
*Assistant Examiner*—Rodney Amadiz
(74) *Attorney, Agent, or Firm*—Birch Stewart Kolasch & Birch LLP

(57) ABSTRACT

A display device driver of the present invention includes: an operational amplifier for generating a plurality of gray level display voltages; a switch for selecting and outputting one of the plurality of gray level display voltages according to display data; and a control circuit for detecting the gray level display voltage that was selected and outputted by the switch from the plurality of gray level display voltages, so as to control the operational amplifier. With this configuration, the display device driver reduces power consumption of the display device.

10 Claims, 14 Drawing Sheets

DISPLAY DEVICE DRIVER, DISPLAY DEVICE AND DRIVING METHOD THEREOF

FIELD OF THE INVENTION

The present invention relates to a display device driver for driving a display device such as a liquid crystal display device to display gray levels. The invention also relates to a display device and a driving method thereof.

BACKGROUND OF THE INVENTION

A conventional liquid crystal display device includes a controller 1001, a source driver 1002, a gate driver 1003, and a liquid crystal panel 1004, as shown in FIG. 9. The liquid crystal panel 1004 described herein uses TFTs (Thin Film Transistors) as the switching element.

The source driver 1002 produces a gray level display signal C based on signal A that is sent from the controller 1001, so as to drive source signal lines of the liquid crystal panel 1004. Examples of signal A includes: serially transferred digital display data A3; a start pulse signal A1 for the source driver, which initiates importing of the display data A3; and a latch signal A2 that latches display data of one horizontal synchronous period, as shown in FIG. 10.

The source driver 1002 operates as follows. In response to a transfer clock signal CKs, the serially transferred display data A3 for image display is held with respect to each output terminal. Based on the display data A3, the gray level display signal C is generated and supplied to each pixel of the liquid crystal panel 1004, so as to decide the brightness of each pixel.

The gate driver 1003 is used to drive each gate signal line of the TFT liquid crystal panel 1004. Specifically, the gate driver 1003 receives a signal B and a transfer clock signal CKg, the signal B being a first line display start signal (start pulse signal for the gate driver), for example. In response to the input of these signals, the gate driver 1003 produces a scanning signal D that sequentially selects display lines, and outputs the scanning signal D to each gate signal line.

The gray level display signal C from the source driver 1002 and the scanning signal D, used to sequentially select display lines, from the gate driver 1003 are so used by the liquid crystal display device to display gray levels (multicolor display) per each gate signal line on the display screen of the liquid crystal panel 1004.

The source driver 1002 is described below in more detail with reference to the block diagram of FIG. 10. The source driver 1002 includes a shift register 1005, a latch memory 1006, a hold memory 1007, a gray level voltage selector 1008, and a gray level voltage generator 1009.

The shift register 1005 starts being operated by the start pulse A1 that initiates drawing data, and outputs a signal F1 in synchronism with the transfer clock signal CKs. The latch memory 1006 draws the serially transferred display data A3 in response to the start pulse signal F1.

The latch memory 1006 is set for each output of the source signal lines. The latch memory 1006 of each output is sequentially selected by the start pulse signal F1, so that the serially transferred display data A3 is sequentially stored in the latch memory of each output. As a result, the serially transferred display data A3 is converted into parallel display data in the source driver 1002.

The display data A3 stored in the latch memory 1006 is transferred to the hold memory 1007 (F2) and is latched by the latch signal A2 corresponding to one horizontal synchronizing signal.

The display data so transferred is sent to the gray level voltage selector 1008 (F3). The gray level voltage selector 1008 selects a gray level display voltage E_x according to the display data from a plurality of gray level display voltages E generated in the gray level voltage generator 1009.

The hold memory 1007 is required to compensate for a delay in charging a pixel capacitance or signal line capacitance of the liquid crystal panel 1004 to bring their potentials to the level of the selected gray level display voltage E_x. The hold memory 1007 stores the display data A3 for one horizontal synchronous period, so as to permit the display data A3 of the next line to be stored in the latch memory 1006 while charging the pixel capacitance or signal line capacitance of the liquid crystal panel 1004.

Referring to FIG. 11, the following describes the gray level voltage generator 1009. The gray level voltage generator 1009 includes a plurality of serially connected resistors R, and a plurality of operational amplifiers 1015 whose non-inverted terminals are connected to each junction between the resistors R and at the both ends of the resistors R. The number of resistors R and the number of operational amplifiers 1015 are set according to the number of gray levels. The output signal from the output terminal of the operational amplifier 1015 is connected to the inverted terminal to create a feedback loop, so that the operational amplifier 1015 serves as a voltage follower that presents a low output impedance.

In the gray level voltage generator 1009, the intermediate voltage of the externally supplied voltages VinpH and VinpL from the both ends of the resistors R is divided by the resistors R. Each fraction of the voltage so divided is subjected to impedance conversion by the operational amplifiers 1015, so as to output the resulting voltages (signals E_1 through E_n) to the gray level voltage selector 1008.

As shown in FIG. 12, the gray level voltage selector 1008 is provided for each output terminal of the hold memory 1007. According to the display data stored in the hold memory 1007, the gray level voltage selector 1008 selects one of the gray level display voltages E_1 through E_n generated in the gray level voltage generator 1009, and outputs a gray level display signal C_x for driving the liquid crystal panel 1004.

As shown in FIG. 13, in the gray level voltage selector 1008, the display data F3, which has been produced by holding the display data A3 in parallel, is received by the multiplexer 1012. The multiplexer 1012 produces a signal G3_x that selects and closes one of the switches 1011 respectively corresponding to the gray level display voltages.

The switch 1011 is, for example, an analog switch that is realized by a pair of PchMOS transistor 1013 and NchMOS transistor 1014, and an inverter 1016 that inverts an input signal to the gate of the NchMOS transistor 1014 so as to supply it to the gate of the PchMOS transistor 1013 (see FIG. 14). Selecting the switch 1011 enables a gray level display voltage to be selected according to the display data F3 and outputted as the gray level display signal C.

In this manner, the LSI, i.e., the source driver 1002, that supplies the gray level display signal C to the liquid crystal display device generates a voltage for each of the gray levels when displaying gray levels according to the video signal, i.e., the display data A3. This is achieved by externally supplying part of gray level display voltages (e.g., a maximum voltage VinpH and a minimum voltage VinpL) to the source driver 1002 and producing therein intermediate voltages. The gray level voltage selector 1008 selects a voltage according to the gray level with respect to each output terminal.

Further, as described above, the liquid crystal panel 1004 has a capacitive load, which causes a voltage drop during charging or discharging of the panel capacitance. In order to prevent this, a buffer circuit such as the operational amplifier 1015 needs to be provided between the terminal of each gray level display voltage and the output terminal, so as to present a low output impedance.

Unlike a digital signal, the voltage levels of the gray level display voltages are highly accurate, and they do not tolerate voltage fluctuations between input and output of the buffer circuit. It is therefore conventionally common that the buffer circuit uses the operational amplifier 1015, which is an analog circuit, as a voltage follower.

One problem of the operational amplifier 1015, however, is that it generally consumes large power. Thus, the power consumption of the source driver 1002 is increased as a whole when the number of gray level display voltages is increased to improve image quality, because in this case the number of operational amplifiers 1015 is increased.

Further, because the gray level display voltages have the same chance of being used, the operational amplifier 1015, which is provided for each gray level display voltage, needs to be operated at all times. This poses the problem of power consumption.

For example, when the source driver 1002 is to display 64 gray levels, 64 operational amplifiers 1015 need to be operated at all times. Similarly, displaying 256 gray levels requires 256 operational amplifiers 1015. That is, increasing the number of gray levels increases the consumed current and thereby increases power consumption.

SUMMARY OF THE INVENTION

An object of the present invention is to provide a display device driver that drives a display device such as a liquid crystal display device to display gray levels, and a driving method of such a display device, which consume low power.

In order to achieve the foregoing object, a display device driver according to the present invention includes: generator for generating a plurality of gray level display voltages; a selector for selecting and outputting one of the plurality of gray level display voltages according to display data; and detector for detecting the gray level display voltage that was selected and outputted by the selector from the plurality of gray level display voltages, so as to control the generator.

According to this configuration, the detector detects the gray level display voltage of each output from the selector, and controls and suspends the operation of the generator if the generator is not connected to the gray level display voltage to be outputted. As a result, low power consumption can be achieved.

In order to achieve the foregoing object, a driving method of a display device according to the present invention includes the steps of: selecting and outputting one of gray level display voltages according to display data; detecting the gray level display voltage that was selected and outputted from the gray level display voltages; and suspending generation of a non-selected one of the gray level display voltages.

According to this method, the detecting step detects the gray level display voltage of each output from the selector, and the suspending step suspends generation of the gray level display voltage if the gray level display voltage is not selected. As a result, low power consumption can be achieved.

For a fuller understanding of the nature and advantages of the invention, reference should be made to the ensuing detailed description taken in conjunction with the accompanying drawings.

DESCRIPTION OF THE EMBODIMENTS

Referring to FIG. 1 through FIG. 8, the following describes a preferred embodiment of a display device driver, a display device, and a driving method thereof according to the present invention. First, the display device using the display device driver will be described with reference to a liquid crystal display device as one example of the display device.

Figure 2:
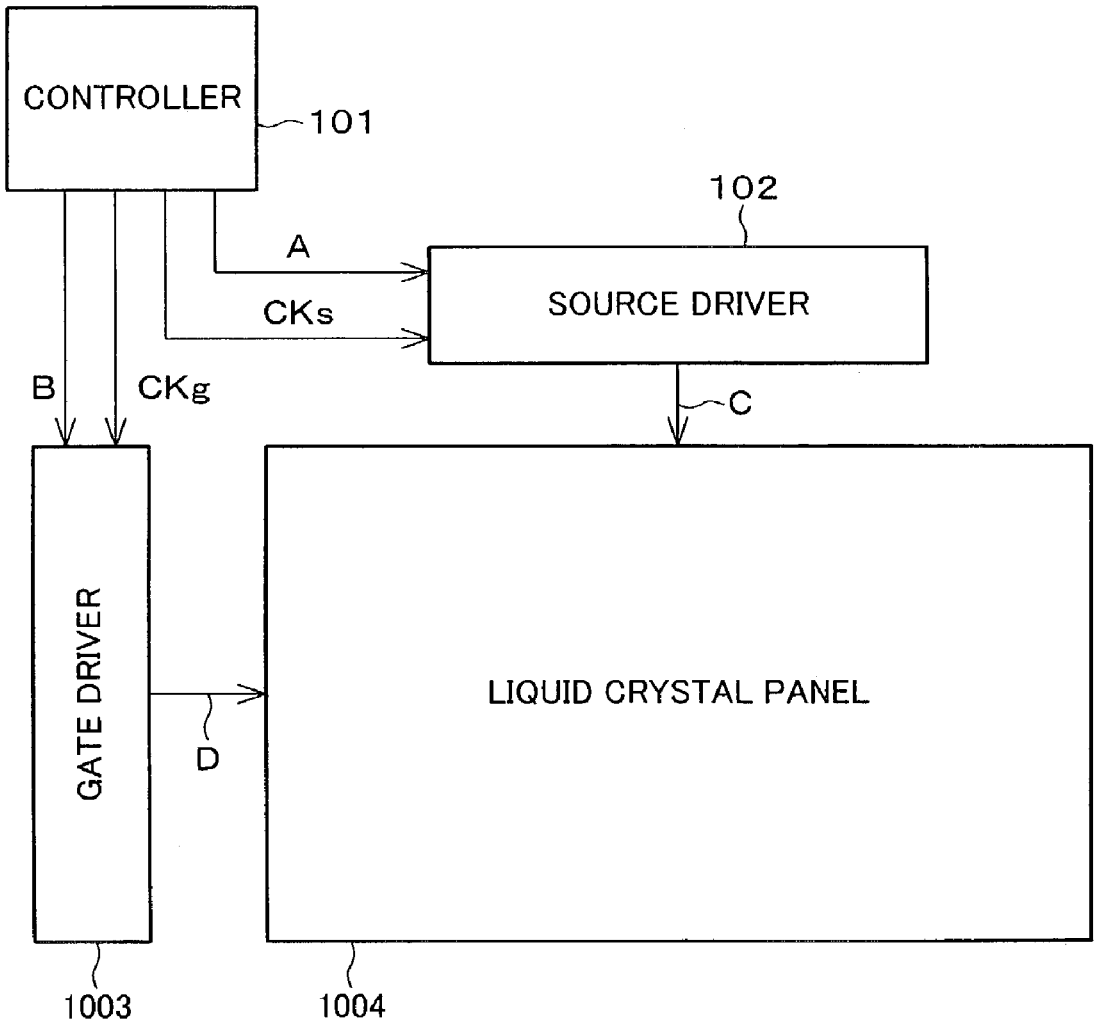
FIG. 2 is a block diagram showing an entire structure of a display device using the display device driver.
Figure 9:
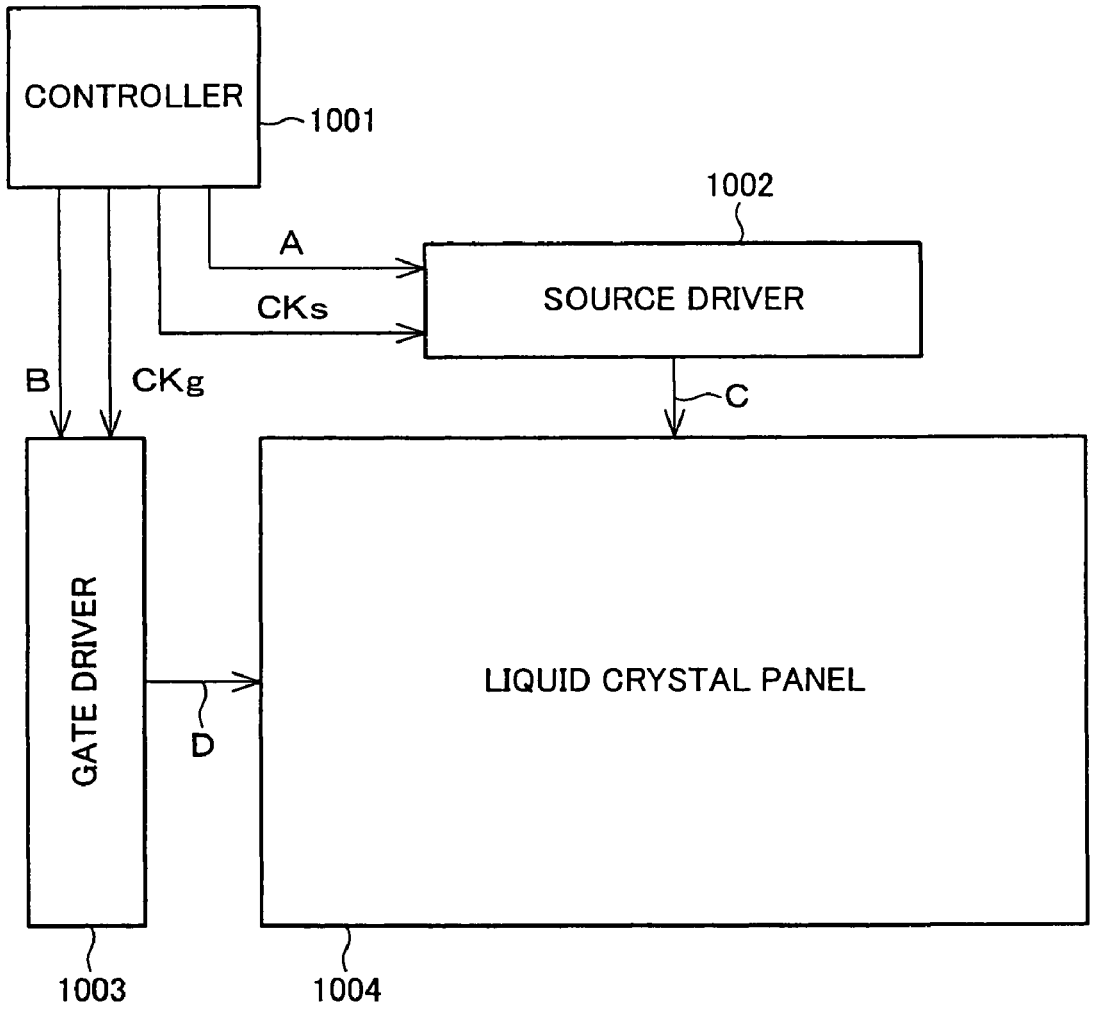
FIG. 9 PRIOR ART
FIG. 9 is a block diagram showing an entire structure of a conventional display device.
Figure 10:
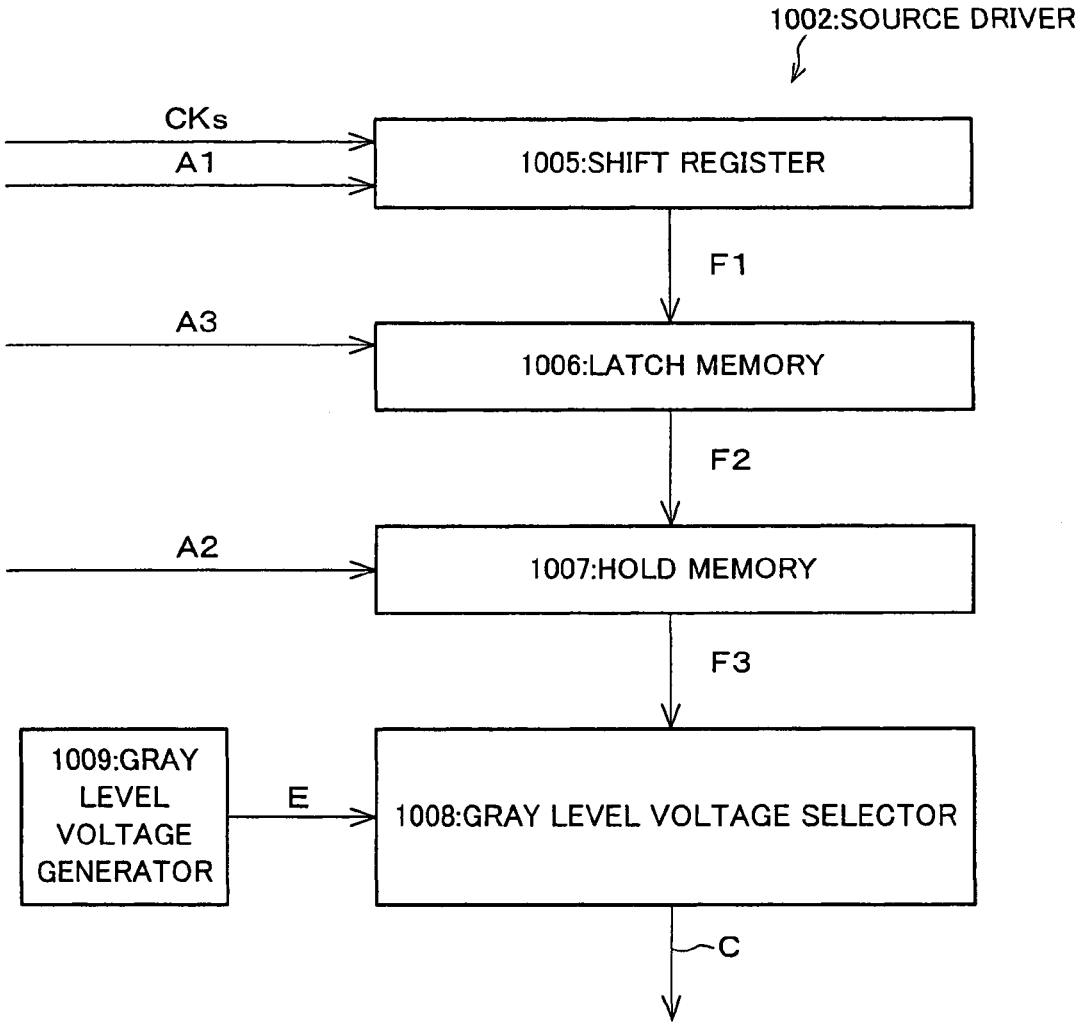
FIG. 10 PRIOR ART
FIG. 10 is a block diagram of a source driver in the conventional display device.
Figure 11:
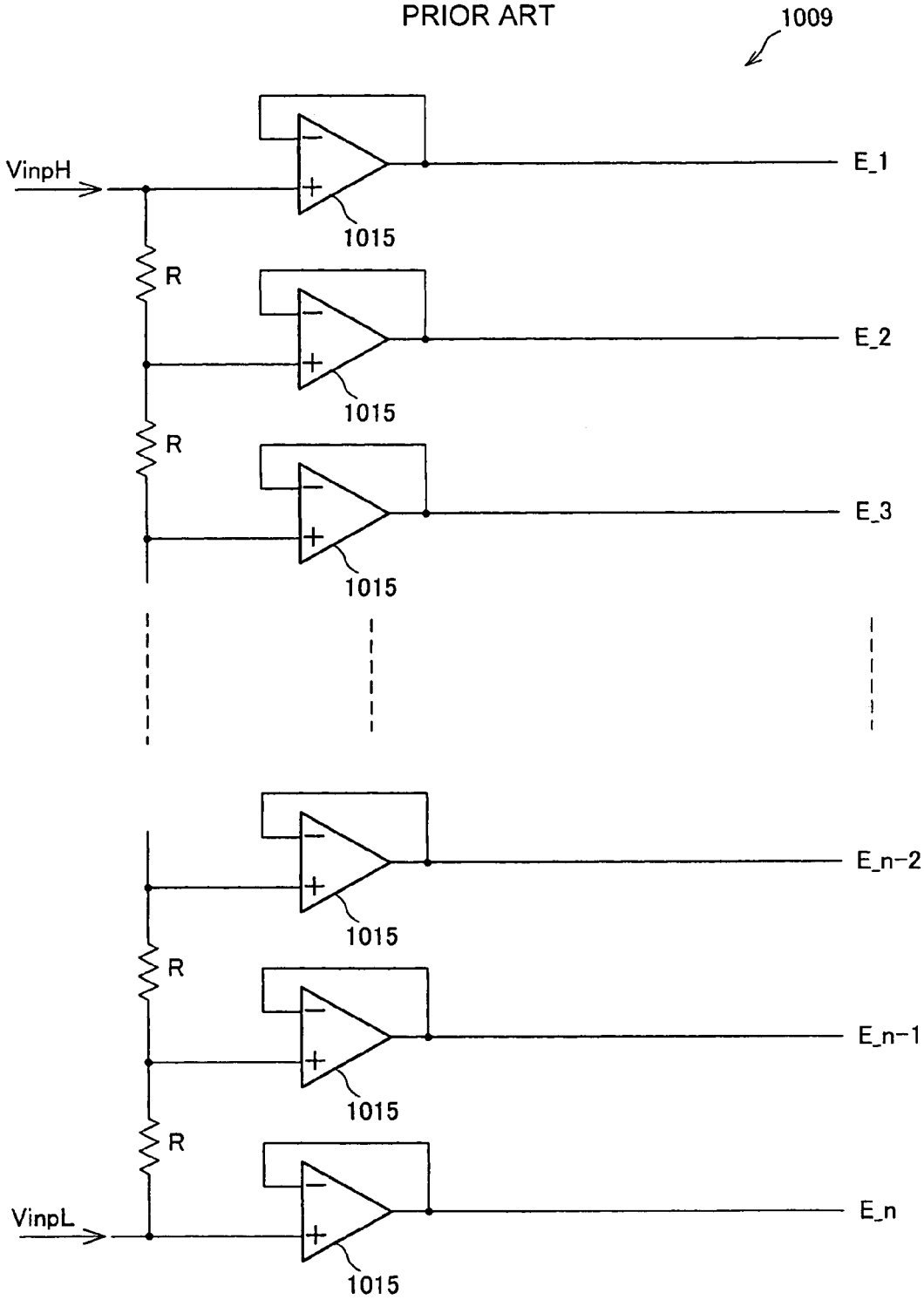
FIG. 11 PRIOR ART
FIG. 11 is a circuit block diagram showing a structure of a gray level voltage generator of the conventional display device.
Figure 12:
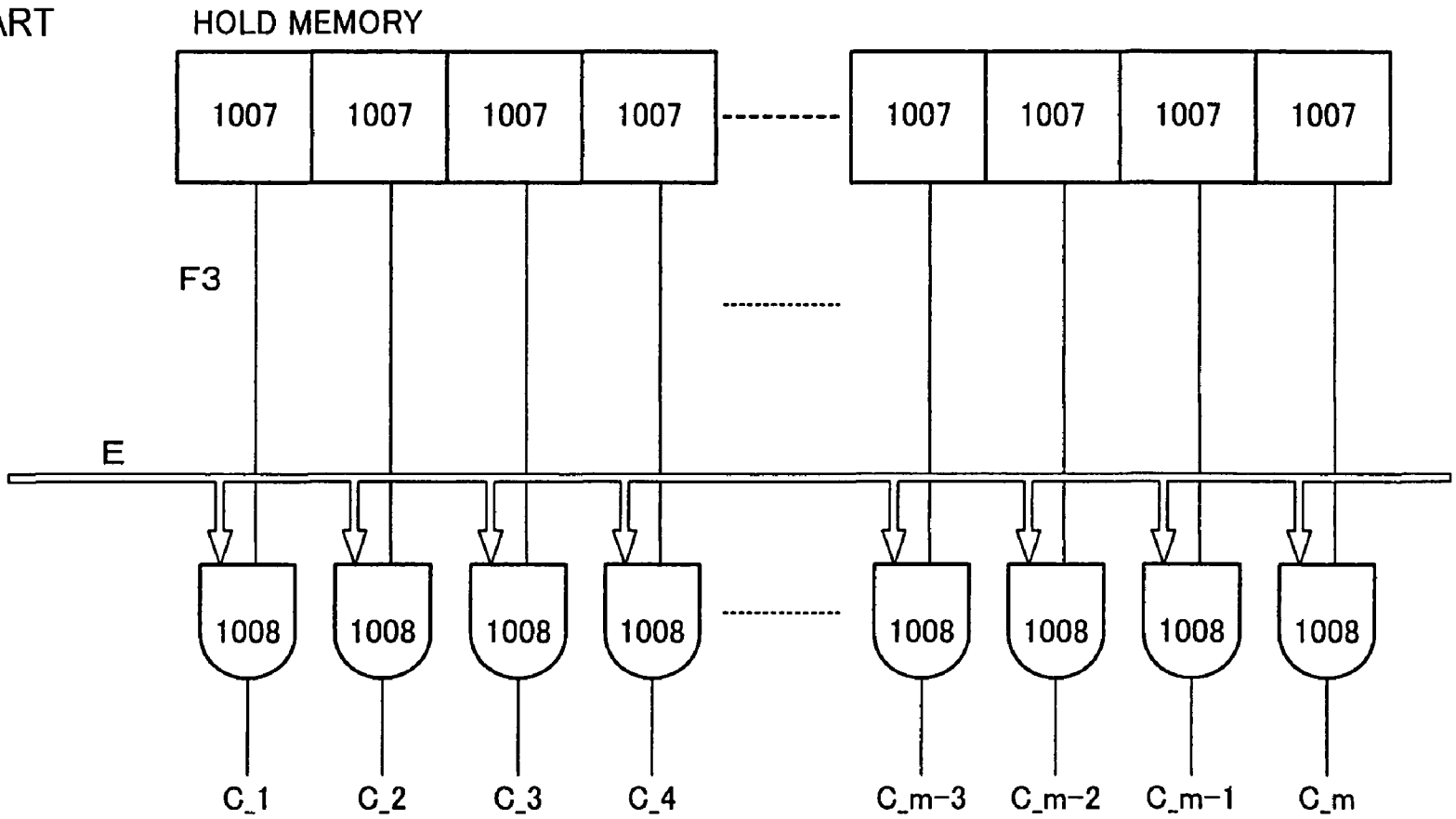
FIG. 12 PRIOR ART
FIG. 12 is a circuit block diagram showing a gray level voltage selector and a hold memory of the conventional display device.
Figure 13:
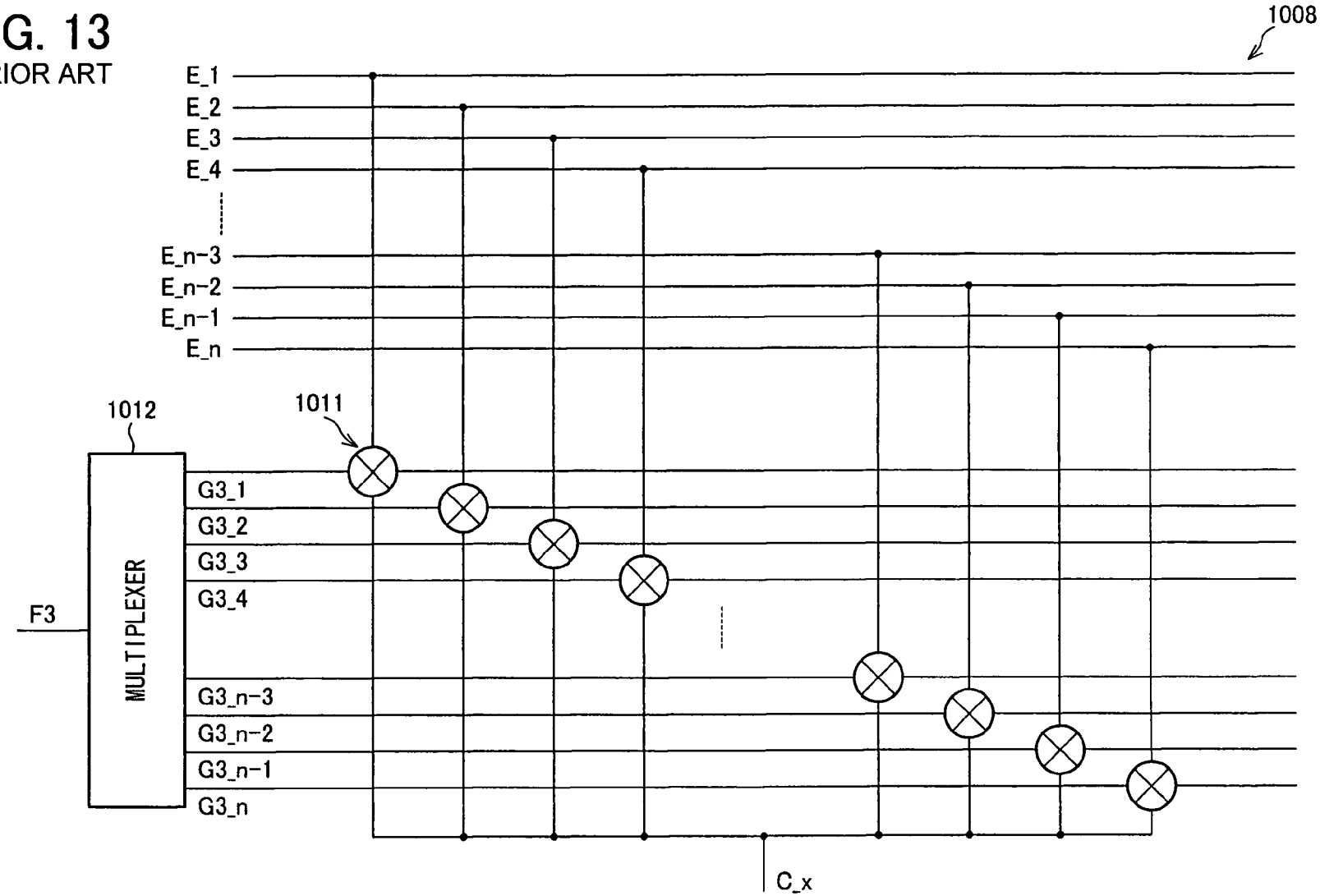
FIG. 13 PRIOR ART
FIG. 13 is a circuit block diagram showing a structure of the gray level voltage selector.

As shown in FIG. 2, the liquid crystal display device includes a controller 101, a source driver (display device driver) 102, a gate driver 1003, and a liquid crystal panel 1004. Note that, members and signals that are functionally equivalent to those already described in connection with the conventional liquid crystal display device shown in FIG. 9 are given the same reference numerals or reference signs and further explanations thereof are omitted here.

Figure 3:
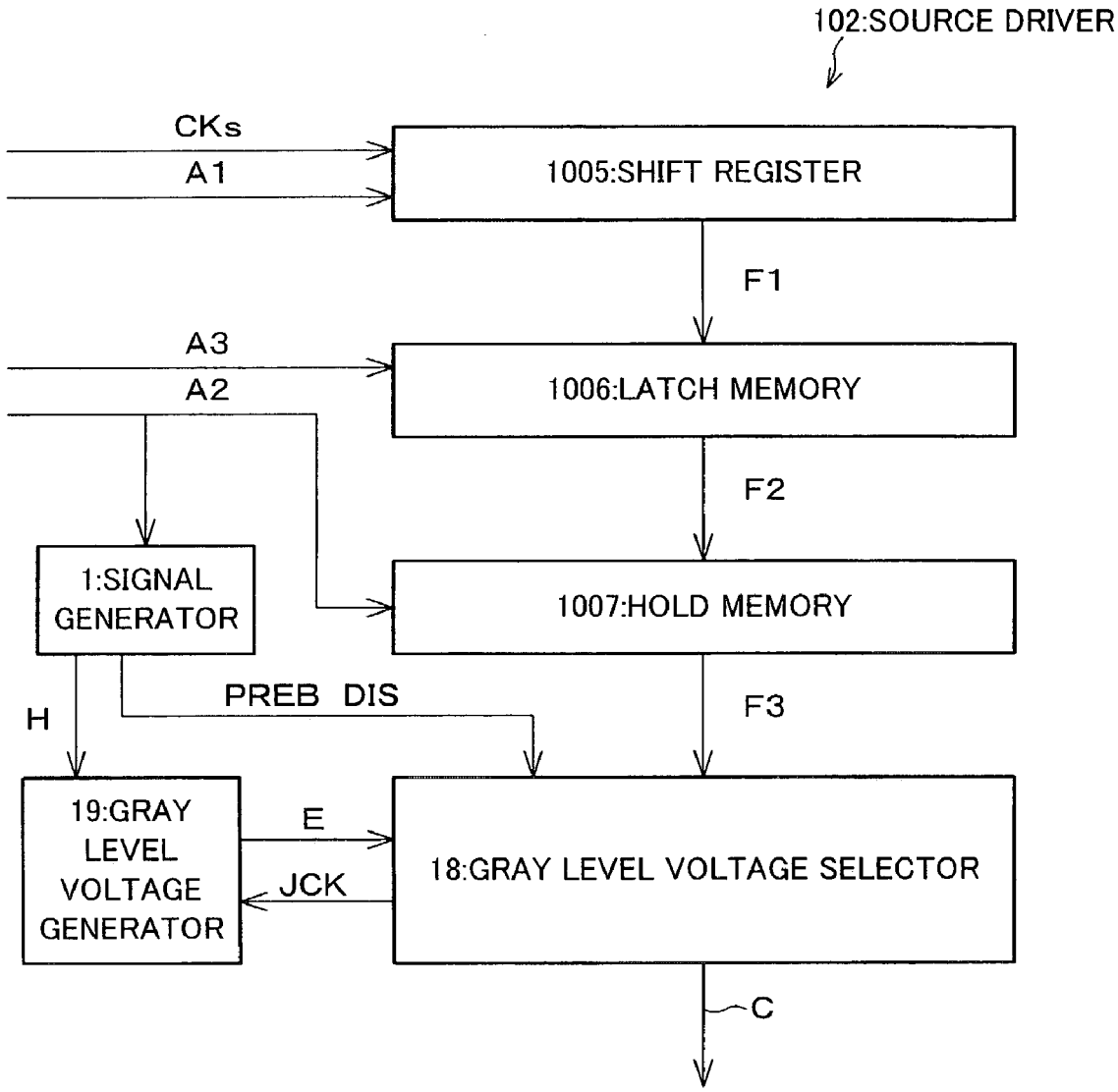
FIG. 3 is a block diagram of a source driver as the display device driver.

The source driver 102 of the present invention includes a shift register 1005, a latch memory 1006, a hold memory 1007, a gray level voltage selector (selecting means) 18, a gray level voltage generator (generating means) 19, and a signal generator 1, as shown in FIG. 3. Note that, the source driver 102 of the present embodiment will not be described with respect to circuits or a circuit block that perform the same operations as those described in reference to the source driver 1002 of the conventional example, including the shift register 1005, latch memory 1006, and hold memory 1005.

Figure 1:
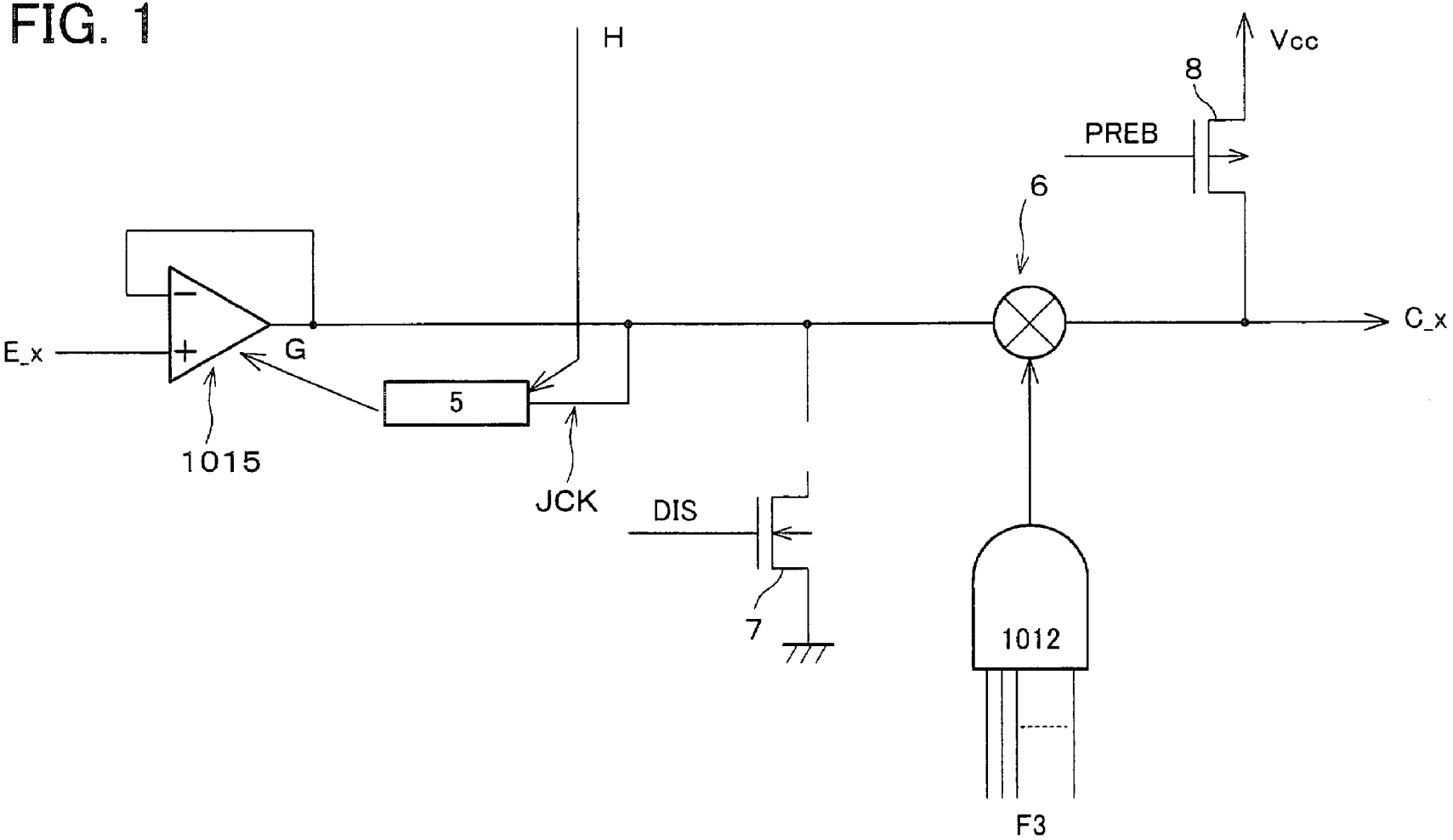
FIG. 1 is a block diagram showing a relevant part of a display device driver of the present invention.

The signal generator 1 is provided in the source driver 102 and produces a control signal H, a signal PREB. The signal generator 1 additionally produces a signal DIS based on a latch signal A2. The gray level voltage selector 18 has an output circuitry (signal lines; to be described later) that is provided with a pull-up transistor (second voltage setting means) 8 and a pull-down transistor (first voltage setting means) 7, as shown in FIG. 1. The pull-up transistor 8 and the pull-down transistor 7 are controlled by the signal PREB and the signal DIS, respectively, and are realized by a PchMOS transistor and an NchMOS transistor, respectively.

The gray level voltage selector 18 of the source driver 102 uses the control signals PREB and DIS to detect (judge) which of gray level display voltages E generated in the gray level voltage generator 19 is selected by the display data, which is stored in the hold memory 1007.

The result of detection is sent back as a signal JCK to an operational amplifier (buffer means) 1015 that outputs a gray level display voltage. The signal JCK is used by the gray level voltage generator 19 to control ON/OFF of the operational amplifier 1015.

FIG. 1 is a circuit block diagram showing the gray level voltage selector 18, along with a gray level display voltage E_x, which is an arbitrary one of gray level display voltages E that are generated in the gray level voltage generator 19. FIG. 1 also shows a gray level display signal C_x, which is a gray level display signal from one of output terminals of the gray level voltage selector 18. A detailed embodiment of the present invention is described below with reference to FIG. 1.

The circuit block shown in FIG. 1 is provided with a control circuit 5 that uses an output signal G to control ON/OFF of the operational amplifier 1015 which receives the gray level display voltage E_x, the control circuit 5 being realized by an OR gate for example.

The control circuit 5 receives a control signal H and the signal JCK. The control signal H (High level or Low level) is used to cause the operational amplifier 1015 to be ON or OFF (high impedance is presented to an output stage). The signal JCK (High level or Low level) is a signal that indicates whether the operational amplifier 1015 is to be used. The control signal H is commonly supplied to each control circuit 5.

It is preferable in the present invention that the control signal H and the signal JCK operate independently. With the control signal H (High level or Low level), a high impedance can be presented to the output of the operational amplifier 1015. The high output impedance prevents the output of the pull-down transistor 7 and the output of the operational amplifier 1015 from competing each other, thereby preventing unnecessary current flow.

It is preferable that the control circuit 5 includes a latch circuit that temporarily latches the signal JCK, and a circuit that generates a timing of drawing a state of the signal JCK (neither is shown). In this way, the ON/OFF control of the operational amplifier 1015 can be more reliably carried out.

Further, in the circuit block shown in FIG. 1, the pull-down transistor 7 is disposed in the vicinity of the input side (E_x side) of the switch 6, so as to control the potential of the signal line on this side of the switch 6. The pull-down transistor 7 becomes ON when the control signal DIS supplied to the gate of the pull-down transistor 7 becomes High level, so that a signal line connected to the pull-down transistor 7 is set to a GND level (first voltage level).

Further, in the circuit block of FIG. 1, the pull-up transistor 8 is disposed in the vicinity of the output side (C side) of the switch 6, so as to control the potential of the signal line on this side of the switch 6. The pull-up transistor 8 becomes ON when the control signal PREB supplied to the gate of the pull-up transistor 8 becomes Low level, so that a line connected to the pull-up transistor 8 is set to a power supply level (for example, Vcc, second voltage level).

By thus disposing the pull-down transistor 7 and the pull-up transistor 8 on the input side and output side of the switch 6, respectively, the output potential of the switch 6 in an ON state can be detected on the input side of the switch 6, so as to detect ON/OFF of the switch 6.

Figure 5:
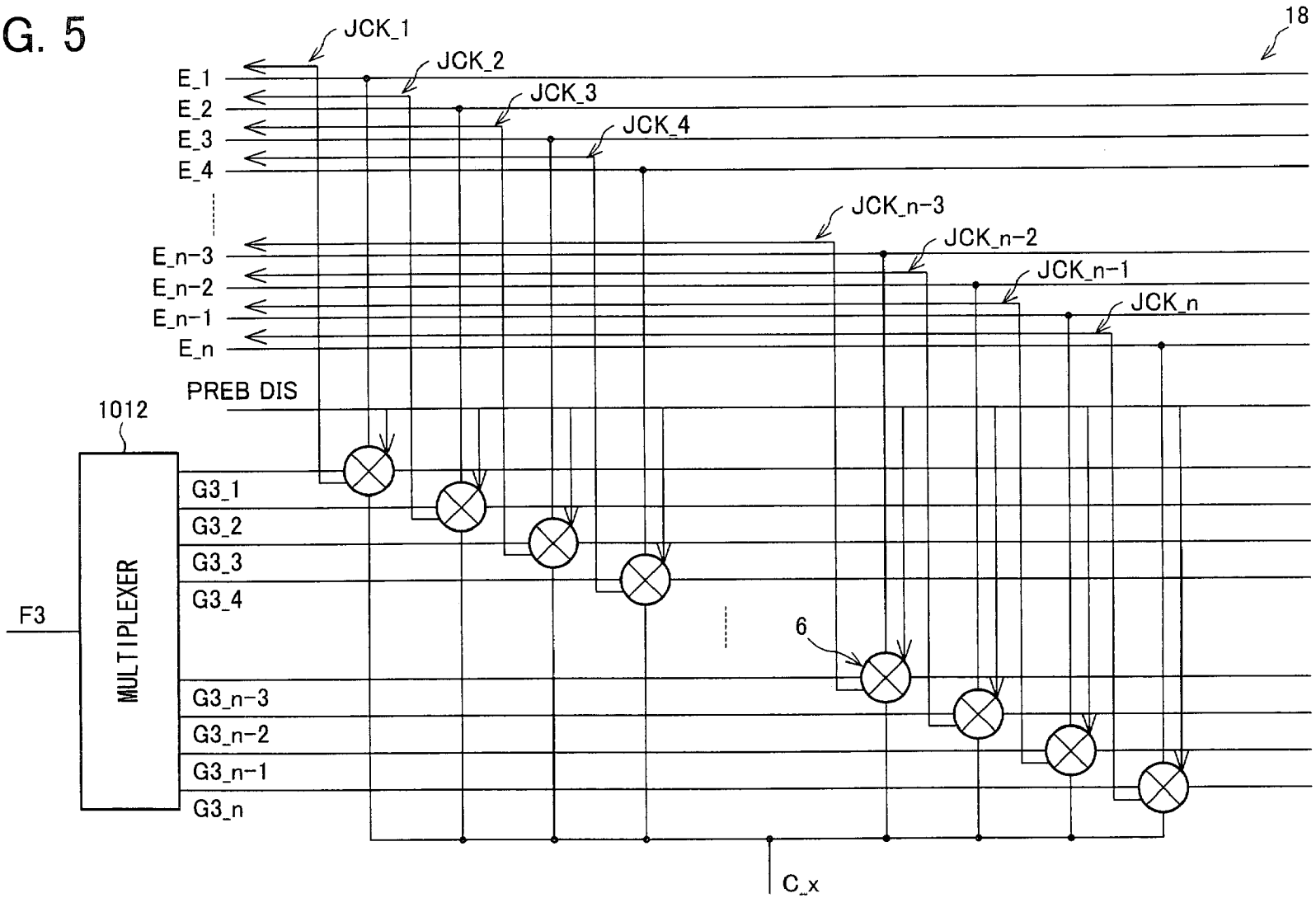
FIG. 5 is a circuit block diagram showing a structure of the gray level voltage selector.

The multiplexer 1012 provided in the gray level voltage selector 18 shown in FIG. 5 is selected by display data F3 for displaying gradation levels, and the multiplexer 1012 causes the switch 6 to close when the display data has a predetermined value. The switch 6, when closed, causes the gray level display signal C, which is a gray level display voltage, to be outputted from the output terminal of the source driver 102 to the corresponding source signal line of the liquid crystal panel 1004.

Figure 6:
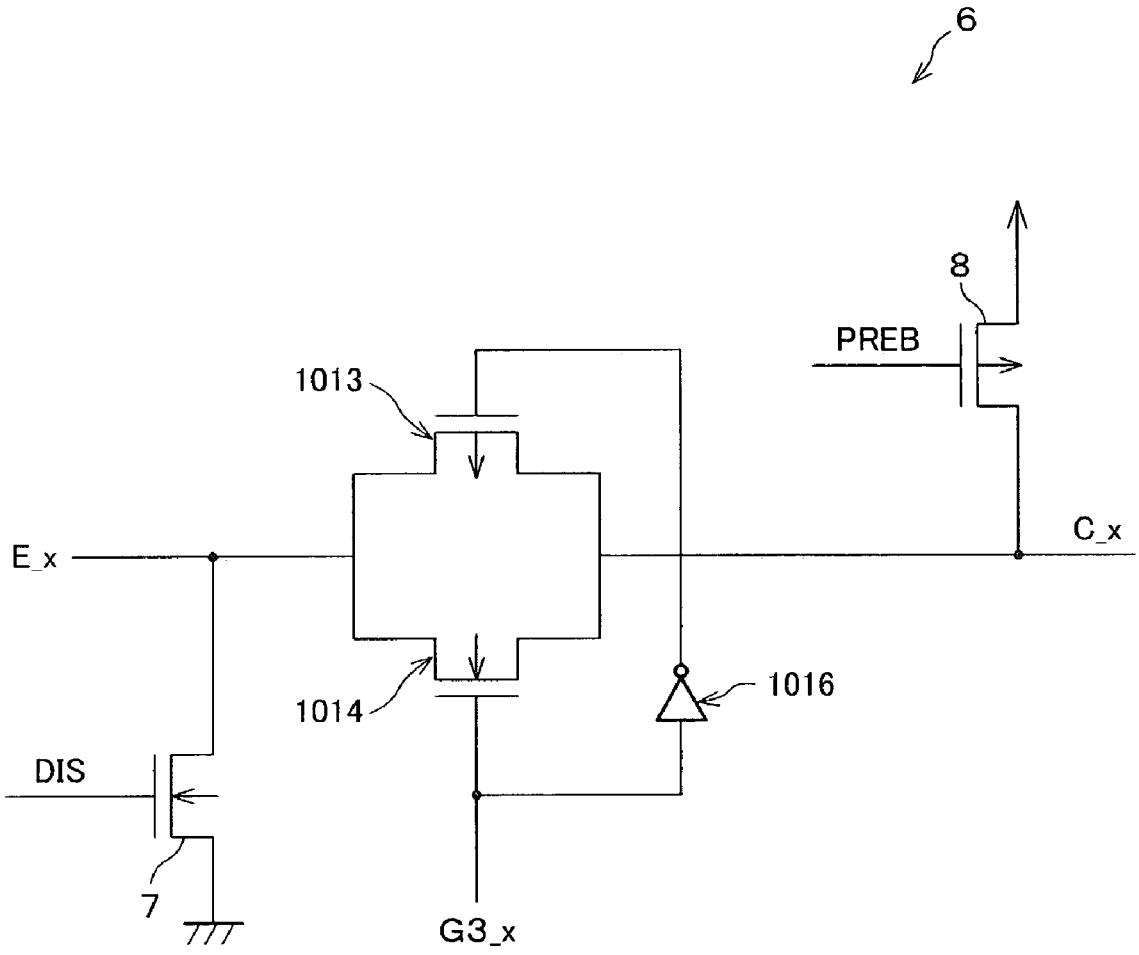
FIG. 6 is a circuit block diagram showing a structure of a switch, a pull-down transistor, and a pull-up transistor in the gray level voltage selector.
Figure 14:
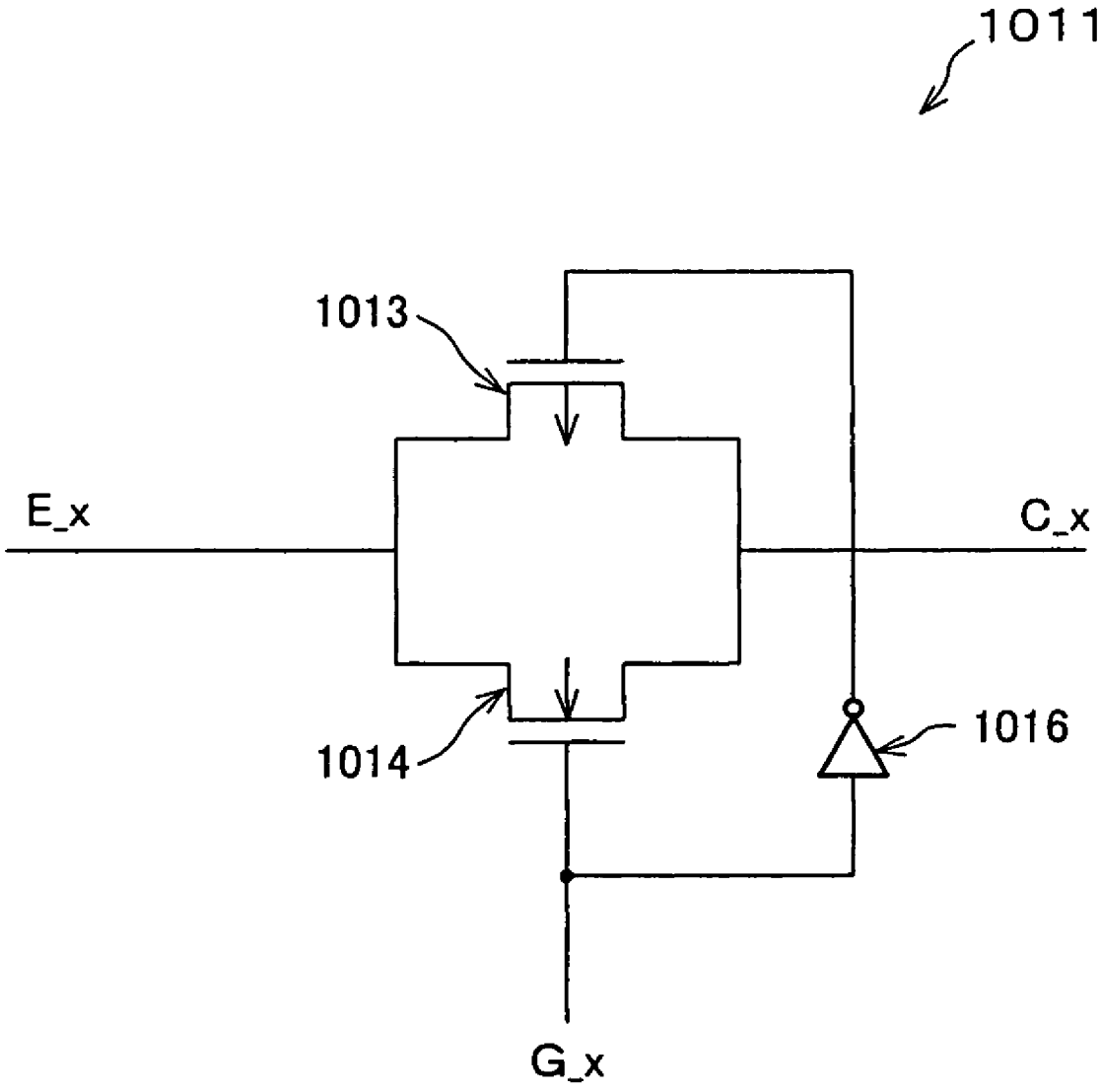
FIG. 14 PRIOR ART
FIG. 14 is a circuit block diagram showing a structure of a switch in the gray level voltage selector.

The switch 6 is realized, for example, by an analog switch as shown in FIG. 6, which is provided in the gray level voltage selector 18 of FIG. 5. The switch 6 includes a MOS transistor and a transmission gate (see FIG. 6) as in the analog switch of the conventional example shown in FIG. 14. The switch 6 differs from the conventional example in that the pull-down transistor 7 and the pull-up transistor 8 are provided on the input terminal and the output terminal, respectively.

Figure 7:
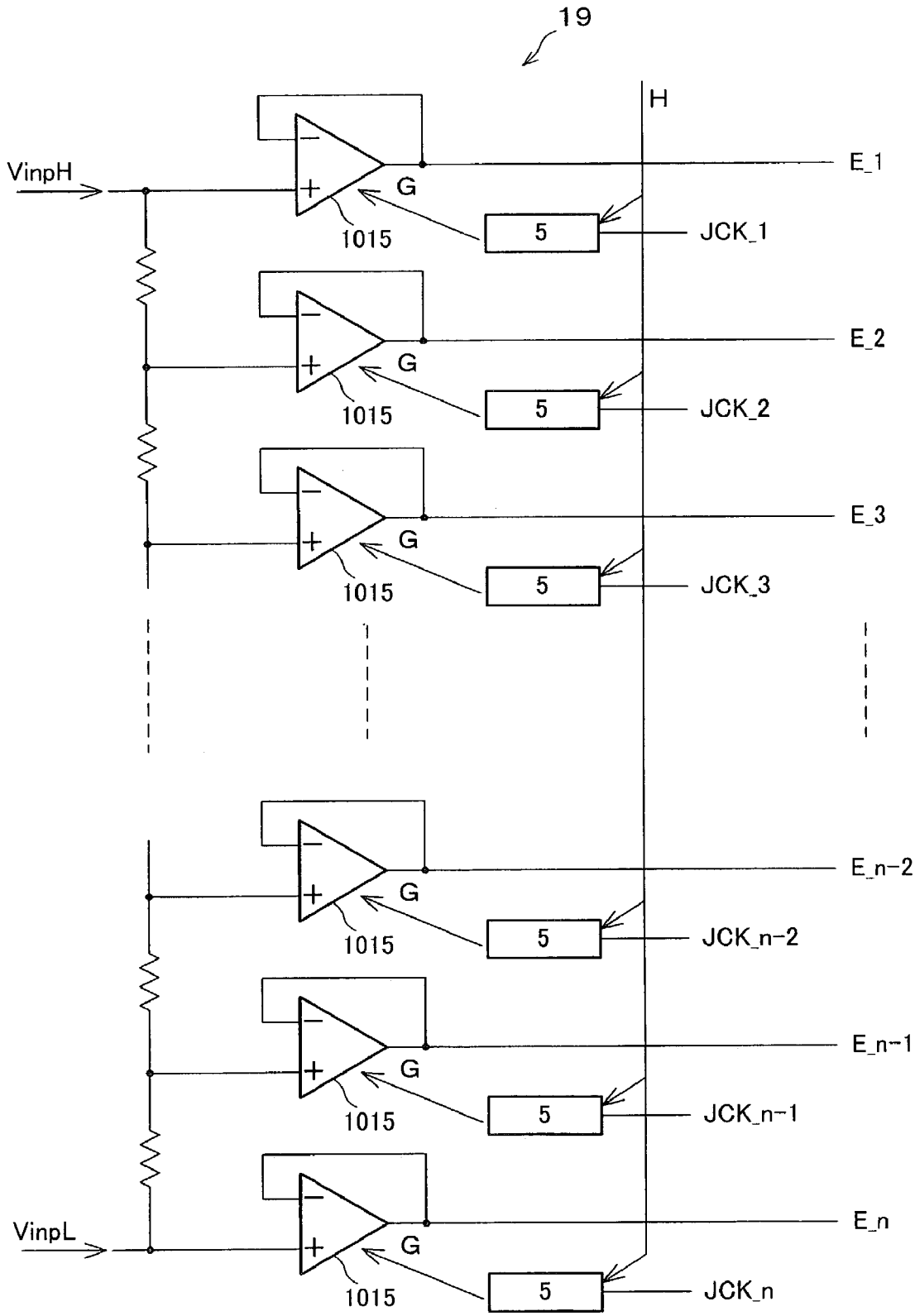
FIG. 7 is a circuit block diagram showing a structure of a gray level voltage generator of the source driver.

The gray level voltage generator 19 differs from the conventional example in that the control circuit 5 is provided for each operational amplifier 1015, as shown in FIG. 7, and the control circuit 5 outputs the output signal G, which, when at High level, turns ON the operational amplifier 1015, and, when Low level, turns OFF the operational amplifier 1015, so that less power is dissipated and a high impedance is presented to the output stage.

Figure 8:
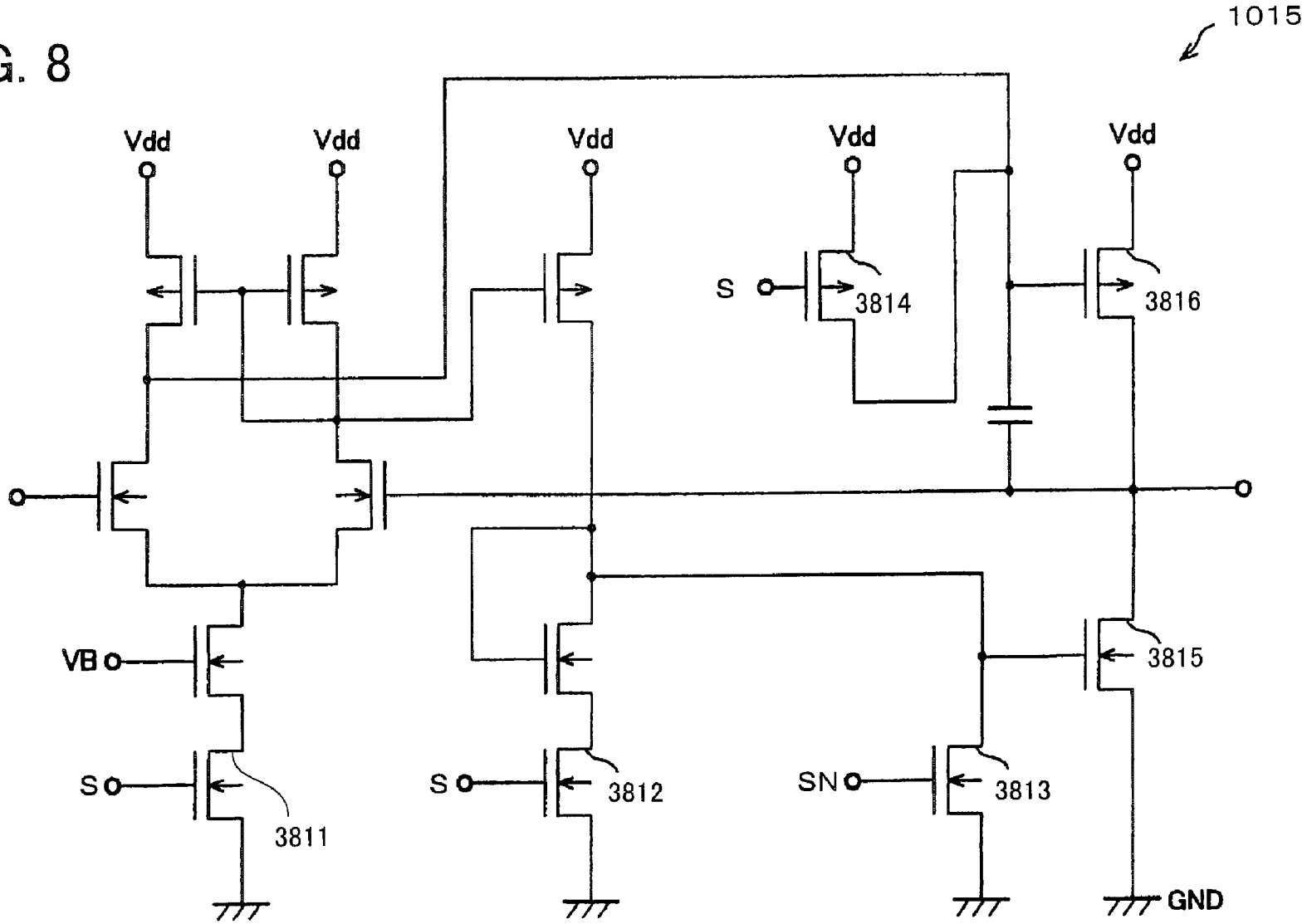
FIG. 8 is a circuit diagram showing a structure of an operational amplifier of the gray level voltage generator.

FIG. 8 shows one example of a circuit structure of the operational amplifier 1015 used in the present invention, in which a differential pair of the input stage is realized by a differential amplifier of NchMOS transistors. As another example, the operational amplifier 1015 may have a structure in which a differential pair of the input stage is a differential amplifier of PchMOS transistors.

In the operational amplifier 1015 shown in FIG. 8, a terminal S receives a signal G, and a terminal SN receives an inverted signal G that has been inverted through an inverter (not shown). Further, indicated by VB in FIG. 8 is a voltage input terminal that sets a value of a constant current flowing into the differential pair, so as to determine an operating point.

In the operational amplifier 1015, the NchMOS transistors 3811 and 3812 are ON when the signal G is at High level (Vdd level), and an ON current is supplied. Here, the NchMOS transistor 3813 and PchMOS transistor 3814 are OFF. That is, the operational amplifier 1015 acts as a voltage follower of a common differential amplifier. The Vdd level is a driving (power supply) voltage of the operational amplifier 1015.

Conversely, when the signal G is at Low level (GND level), the NchMOS transistors 3811 and 3812 are OFF, and the supply of the ON current is suspended. Here, the NchMOS transistor 3813 and the PchMOS transistor 3814 are ON. This turns OFF the NchMOS transistor 3815 and the PchMOS transistor 3816 on the output stage of the operational amplifier 1015. That is, the operational amplifier 1015 is turned OFF by the high output impedance. As a result, there is no ON current and therefore no power dissipation.

The control circuit 5 of the present invention may be realized by an OR gate, which is notably simple in structure. In response to the input of a signal (signal JCK at low level) that maintains an OFF state of the operational amplifier 1015 provided as a buffer circuit, the control circuit 5 cuts off the power supply to the operational amplifier 1015 and presents a high impedance to the output of the operational amplifier 1015. Note that, the foregoing described the case where the operational amplifier 1015 itself carries out the operations of cutting off the power supply and presenting a high impedance to the output. Alternatively, these operations may be carried out in the control circuit 5.

In this case, the control signal H supplied to the control circuit 5 is set to Low level in the control circuit 5 (here, signal JCK is also at Low level), so that the signal G supplied to the operational amplifier 1015 become Low to turn off the operational amplifier 1015 and to present a high impedance to the operational amplifier 1015. Discharging the signal line brings the signal JCK to High level and turns on the operational amplifier 1015. Conversely, precharging the signal line brings the signal JCK to Low level and turns off the operational amplifier 1015. Details of discharging and precharging the signal line will be described later.

Note that, the domain of FIG. 1 from the gray level display voltage E_x to the pull-down transistor 7 may be realized by a circuit provided in the gray level voltage generator 19. Generally, the circuit is preferably provided for each operational amplifier 1015 of the source driver 102 and is common to the signal lines of the gray level display voltages E_x.

It is preferable that the switch 6, the multiplexer 1012, and the pull-up transistor 8 are provided in the gray level voltage selector 18 and for each output terminal to the source signal line.

In response to an output control signal such as the horizontal synchronizing signal produced in the controller 101, the source driver 102 outputs the gray level display signal C simultaneously from all the output terminals that are respectively connected to the source signal lines of the liquid crystal panel 1004.

The source driver 102 of the present invention outputs the gray level display voltage C to each pixel of the liquid crystal panel 1004 via the source signal line, based on the latch signal A2, which is a horizontal synchronizing signal. However, before outputting the gray level display voltage C, the source driver 102 carries out the following operations.

Step 1: After receiving the control signal H (here, Low level) from the controller 101, the signal DIS supplied from the controller 101 (commonly supplied to the gate of the pull-down transistor 7 of each gray level display voltage) is set to High level, so as to turn on the pull-down transistor 7 and discharge the output signal line of the operational amplifier 1015 to GND level (Low level, first voltage value) (first setting step). The signal line of the GND level and the control signal H turns on the control circuit 5, so as to temporarily turn off all the operational amplifiers 1015 connected to the gray level display voltages of the source driver 102. After discharging, the signal DIS is set to Low level to turn off the pull-down transistor 7.

Step 2: The display data F3 for displaying gray levels, which was read in the previous display period (display data F3 that has been latched after being fetched in the previous horizontal synchronous period of the liquid crystal panel 1004) operates the multiplexer 1012. The multiplexer 1012 then selects a switch 6 according to the display data F3 and causes the switch 6 to close while the switches 6 of the non-selected lines remain off.

Step 3: Then, the signal PREB (commonly supplied to the gate of each pull-up transistor 8 of each switch 6) is set to Low level, so as to turn on the pull-up transistor 8 and precharge all lines to the power supply voltage. After precharging, the signal PREB is set to High level to turn off the pull-up transistor 8.

Step 4: The signal line that is connected to the output stage of the operational amplifier operating on the power supply voltage is precharged to a power supply voltage level (e.g., Vcc level, second voltage value, if this signal line is connected to the switch 6 that is selected to display a gray level (second setting step). As a result, the signal JCK becomes High level. On the other hand, the signal line that is connected to the output stage of the operational amplifier operating on the power supply voltage is not precharged and the discharged state is maintained if the switch 6 connected to this signal line is not selected by the display data. As a result, the signal JCK becomes Low level.

Step 5: The control circuit 5 reads the value of the signal JCK. When the signal JCK is at High level, the control circuit 5 judges that the operational amplifier 1015 of the source driver 102 connected to the power supply voltage will be used, so as to set the signal G at High level and operate the operational amplifier 1015. On the other hand, when the signal JCK is at Low level, the control circuit 5 judges that the operational amplifier 1015 of the source driver 102 connected to the power supply voltage will not be used, so as to maintain the off state of the operational amplifier 1015 (suspending step).

Step 6: The foregoing steps 1 through 5 are successively carried out in each horizontal synchronous period. The operations of steps 1 through 5 are preferably carried out within an off period of the scanning signal D (gate signal) that is supplied from the gate driver 1003.

However, the operations of steps 1 through 5 may also be carried out within an on period of the scanning signal D without causing an adverse effect on the display. This is possible because the time required to carry out the operations of steps 1 through 5 can be made shorter than the on period (scanning period) of the gate, and because the voltage that was pulled-up is converted to a gray level display voltage of a predetermined level in an on state of the gate (before the gate becomes off) when connected to the buffer (operational amplifier 1015) in a later step. Another reason is that the gate is off and the pixel maintains a predetermined voltage in a non-scanning period (period sufficiently longer than the scanning period).

That is, applying voltages of various levels to the pixel when the gate is on does not cause any problem even when the voltage is pulled-up and does not have a predetermined level. This is because, when the gate is off, the voltage applied to the pixel during the on period of the gate, regardless of its level, creates a potential that is substantially equal to the potential to be applied to the pixel.

Note that, another analog switch may be provided on the output stage of the gray level voltage selector 18, so that the analog switch opens when the voltage is pulled-up according to the signal PREB and closes when the operational amplifier 1015 is operated by the signal G. In this way, voltage fluctuations of detecting operations will not be applied to the pixels of the liquid crystal.

The foregoing described the operation of gray level display with respect to one of the gray level display voltages and one output. However, the foregoing operation may be carried out simultaneously with respect to all the outputs of the gray level display signals C for driving the liquid crystal panel 1004. In this case, all the operational amplifiers 1015 respectively corresponding to the gray level display signals C are once turned off, and the operational amplifiers 1015 are turned on when at least one of the source signal lines is used, and are turned off when none of the source signal lines is used.

Figure 4:
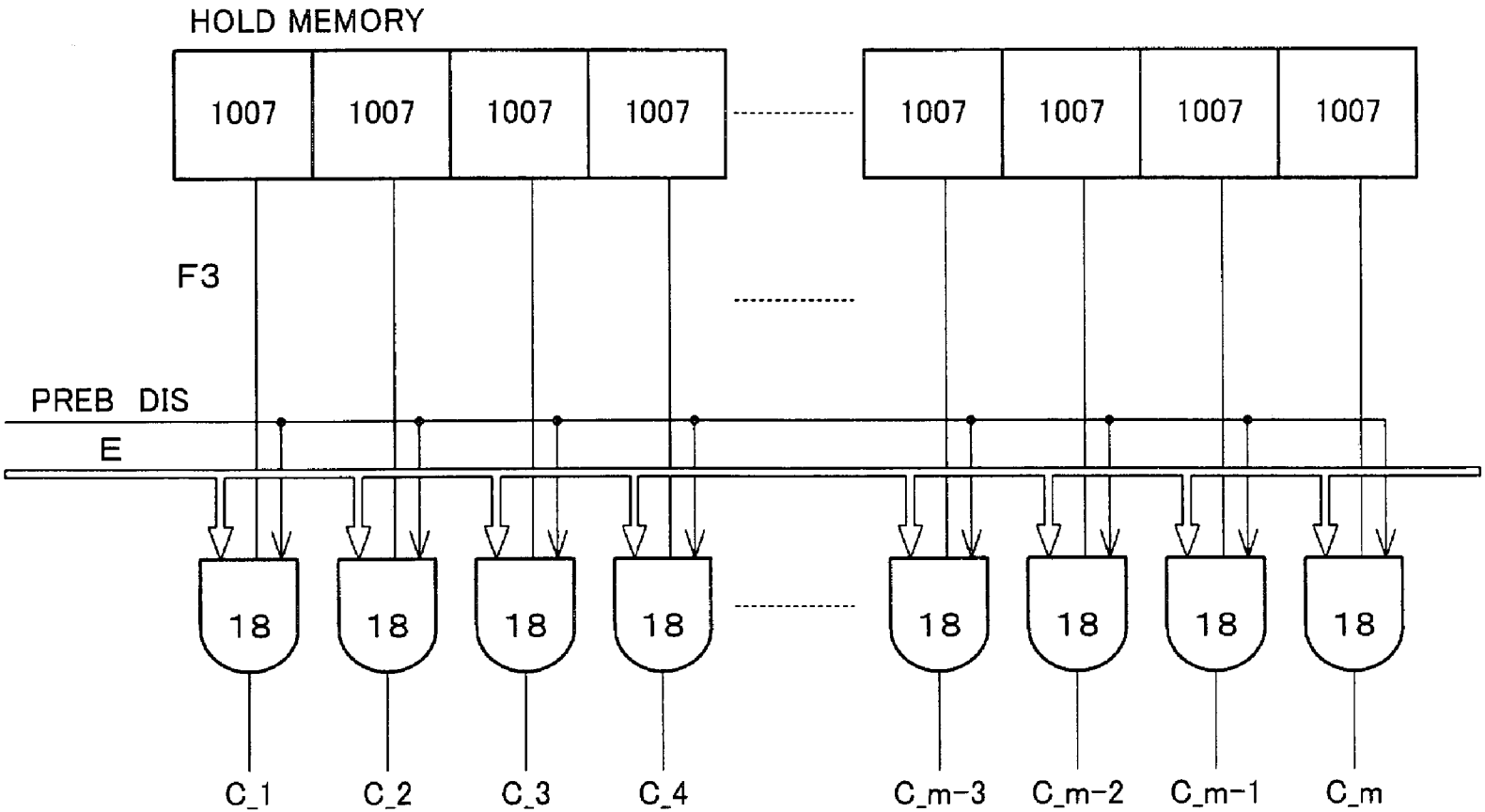
FIG. 4 is a block diagram showing a gray level voltage selector and a hold memory of the source driver.

The following describes the case of n gray levels and m outputs (C1 through Cm). FIG. 4 shows hold memories 1007 and gray level voltage selectors 18 of the present invention. FIG. 5 shows the gray level voltage selector 18 of one output.

The switches 6 shown in FIG. 5 have a circuit structure as shown in FIG. 6, in which the pull-up transistor 8 and the pull-down transistor 7 are provided. FIG. 7 shows gray level voltage generators 19 that respectively produce gray level display voltages E_1 through E_n of n gray levels.

The gray level display voltages of n gray levels are produced by resistance division, and are outputted as gray level display voltages E_1 through E_n through the operational amplifiers 1015 and the control circuits 5. The following describes operations of the source driver 102 before it outputs the gray level display signals C.

Step I: After the control signal H (here, Low level) has been generated, the signal DIS shown in FIG. 6 is set to High level, so as to operate the pull-down transistor 7 and discharge the output signal line of the operational amplifier 1015 to GND level (first voltage value) (first setting step). The GND level and the control signal H causes the control circuit 5 to be on, so as to operate all the operational amplifiers 1015 connected to the gray level display voltages of the source driver 102. As a result, all the signal lines of the gray level display voltages E_1 through E_n are discharged. After discharging, the signal DIS is set to Low level to turn off the pull-down transistor 7.

Step II: The multiplexer 1012 is operated by the display data F3 that was read during the previous horizontal synchronous display period. The multiplexer 1012 selects one of the n switches 6 and causes only the selected one of the switches 6 to close while the other switches 6 remain OFF.

Step III: The signal PREB shown in FIG. 6 is set to Low level, so as to operate the pull-up transistor 8 and precharge the output signal line of the switch 6 to a power supply voltage (e.g., Vcc). After precharging, the signal PREB is set to High level and the pull-up transistor 8 is turned off. As a result of this operation, the signal line of the selected switch 6 of the selected gray level display voltage E_x is precharged to a power supply voltage (second voltage value) (second setting step), while the non-selected signal lines of the gray level display display voltages remain discharged.

For example, when all outputs select the gray level display voltage E_1, only the signal line of the gray level display voltage E_1 is precharged while the signal lines of the gray level display voltages E_2 through E_n remain discharged (Example 1).

As another example, when one of m outputs selects the gray level display voltage E_2 while the remaining m-1 outputs select the gray level display voltage E_1, the signal lines of E_1 and E_2 are precharged and the gray level display voltages E_3 through E_n are discharged (Example 2).

Step IV: The states of precharging and discharging of the gray level display voltage lines are supplied to the respective control circuits 5 as shown in FIG. 7 in the form of the signals JCK_1 through JCK_n. In the state of precharging, the signal JCK is at High level. In the state of discharging, the signal JCK is maintained at Low level. In Example 1, only the signal JCK_1 is at High level and the signals JCK_2 through JCK_n are at Low level. In Example 2, the signals JCK_1 and JCK_2 are High level while the signals JCK_3 through JCK_n are Low level. Note that, as can be seen from FIG. 5, the signal JCK_1 is a signal that is obtained through the OR gate from m signals JCK_11 to JCK_1 m of C1 through Cm. Similarly, the other signals JCK_n are obtained through the OR gate from signals JCK_n 1 through JCK_nm of C1 through Cm.

Step V: The control circuit 5 reads the value of the signal JCK. If the signal JCK is at High level, the control circuit 5 judges that the operational amplifier 1015 of the source driver 102 connected to the gray level display voltage is to be used and the operational amplifier 1015 is operated. On the other hand, if the signal JCK is at Low level, the control circuit 5 judges that the operational amplifier 1015 of the source driver 1012 connected to the gray level display voltage will not be used and the off state of the operational amplifier 1015 is maintained.

Step VI: The foregoing operation of steps I through V is carried out for each horizontal synchronous period of the liquid crystal display.

In this manner, a reverse current flow through the switch 6 is detected (tested) to judge whether which of the gray level display voltages is to be used with respect to each output, so that the off state of the operational amplifier corresponding to the gray level display voltage to be used is released by the reverse current flow, while the off state of the operational amplifiers 1015 corresponding to the gray level display voltages that are not to be used is maintained. Such a detecting mechanism is used with the switch 6 to achieve low power dissipation without complicating the circuit structure.

The source driver 102 of the present invention can be suitably used as long as the gray level voltage generator 19 is provided with operational amplifiers (of a voltage follower type in this example), and the gray level display voltage selected by the switch 6 according to the display data signal F3 in the gray level voltage selector 18 is directly supplied to the source signal line of the liquid crystal panel 1004. The low power dissipation of the source driver 102 according to the present invention is particularly more effective in applications where the size of the liquid crystal panel 1004 is small, as in portable devices such as cellular phones.

The low power dissipation of the present invention is even more effective in the display of a cellular phone, in which the same background is usually displayed on a standby screen so that only the operational amplifiers 1015 that are involved in the gray level display voltages to be used need to be operated. The effect of low power dissipation by the present invention is also notable when displaying characters as in mails, because in this case the display only takes the value of 1 or 0 and no intermediate gray levels are necessary, allowing only two of the operational amplifiers 1015 to be used.

Further, lower power consumption can be achieved by suspending the operation of the operational amplifiers 1015 using the control signal H, when no scanning signal D is supplied from the gate driver 1003, for example, in the display of standby screen.

Note that, the foregoing described the case where the operational amplifier 1015 is provided for each gray level display voltage line. However, the present invention can also be implemented only with some of the constituent parts of the operational amplifier 1015 (for example, such as the lines VinpH and VinpL, or some of the intermediate voltages), provided that it does not cause voltage fluctuations when charging or discharging the capacitance component of the pixels or other elements of the liquid crystal panel 1004.

The present invention can detect which gray level power supply is to be used with respect to each output. This enables the operation of the operational amplifiers of non-selected gray level power supplies to be suspended, thereby achieving low power dissipation. For example, in the case where the power supplies have 64 gray levels, the amount of consumed current can be reduced to 1/64 when the display uses only one of the gray level display voltages (displaying only one color).

The foregoing described the case where the display device is a liquid crystal display device. However, it is clear from the foregoing embodiment that the present invention is also applicable to other types of display devices (for example, various types of flat displays such as plasma display and electroluminescence display) in which gray levels are displayed on pixels that are disposed in a matrix.

As described, in order to achieve the foregoing object, a display device driver of the present invention includes: generating means for generating a plurality of gray level display voltages; selecting means for selecting and outputting one of the plurality of gray level display voltages according to display data; and detecting means for detecting the gray level display voltage that was selected and outputted by the selecting means from the plurality of gray level display voltages, so as to control the generating means.

According to this configuration, the detecting means detects the gray level display voltage of each output of the selecting means, and controls and suspends operation of the generating means if the generating means is not connected to the gray level display voltage to be outputted. As a result, low power consumption can be achieved.

It is preferable in the display device driver that the generating means includes buffer means for reducing an output impedance, and the detecting means controls an operation of the buffer means.

According to this configuration, by controlling the operation of the buffer means that consumes large power, even lower power consumption can be achieved.

The display device driver may be adapted so that the detecting means turns off the buffer means if a corresponding gray level display voltage of the buffer means in the generating means is not selected.

According to this configuration, by turning off the buffer means that corresponds to a non-selected gray level display voltage, even lower power consumption can be achieved.

The display device driver may be adapted so that the detecting means includes first voltage setting means and second voltage setting means, so that a different voltage level is set depending on whether the selecting means is selected or not selected.

According to this configuration, by the provision of the first voltage setting means and the second voltage setting means, the detecting means can detect a selected state and a non-selected state of the selecting means. As a result, low power consumption is achieved with a simple structure.

The display device driver may be adapted so that the detecting means includes control means for turning off the buffer means according to a result of detection.

According to this configuration, the buffer means, which consumes large power, is turned off by the control means according to a non-selected gray level display voltage. As a result, lower power consumption can be achieved.

It is preferable in the display device driver that the detecting means comprises the selecting means and interconnections of the selecting means.

According to this configuration, by using the selecting means and the interconnections of the selecting means to realize the detecting means, low power consumption can be achieved with a simple structure.

It is preferable in the display device driver that the detecting means detects an output potential of the selecting means on an input side of the selecting means.

According to this configuration, by using the selecting means and the interconnections of the selecting means to realize the detecting means, low power consumption can be achieved with a simple structure.

As described, in order to achieve the foregoing object, a driving method of a display device of the present invention includes the steps of: selecting and outputting one of gray level display voltages according to display data; detecting the gray level display voltage that was selected and outputted from the gray level display voltages; and suspending generation of a non-selected one of the gray level display voltages.

According to this method, the gray level display voltage that was selected and outputted is detected, so that generation of a non-selected gray level display voltage, which does not need to be outputted, can be suspended. As a result, low power consumption can be achieved.

The driving method may be adapted so that the detecting step further includes: a first setting step of forcibly setting a first voltage level; and a second setting step of changing the first voltage level to a second voltage level, so that the gray level display voltage takes different values when selected and not selected.

According to this method, by the first setting step and the second setting step, a selected state and a non-selected state can be detected according to whether the gray level display voltage is selected or not selected. This enables the gray level display voltage to be generated and suspended at suitable timings. As a result, low power consumption can be achieved with a simple structure.

It is preferable in the driving method that, in the detecting step, buffer means that corresponds to a non-selected gray level display voltage is turned off.

According to this method, the buffer means, which consumes large power, is turned off according to a non-selected gray level display voltage. As a result, even lower power consumption can be achieved.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device driver, comprising:

generating means for generating a plurality of gray level display voltages;

selecting means for selecting and outputting one of the plurality of gray level display voltages according to display data; and detecting means for detecting the gray level display voltage that was selected and outputted by the selecting means from the plurality of gray level display voltages, so as to control the generating means, the detecting means including first voltage setting means provided on an input side of the selecting means, and second voltage setting means provided on an output side of the selecting means.

2. The display device driver as set forth in claim 1, wherein:

the generating means includes buffer means for reducing an output impedance, and the detecting means controls an operation of the buffer means.

3. The display device driver as set forth in claim 2, wherein the detecting means turns off the buffer means if a corresponding gray level display voltage of the buffer means in the generating means is not selected.

4. The display device driver as set forth in claim 2, wherein the detecting means includes control means for turning off the buffer means according to a result of detection.

5. The display device driver as set forth in claim 1, wherein the detecting means comprises the selecting means and interconnections of the selecting means.

6. The display device driver as set forth in claim 1, wherein the detecting means detects an output potential of the selecting means on an input side of the selecting means.

7. A driving method of a display device, comprising the steps of:

selecting and outputting, with a switch, one of gray level display voltages according to display data;

detecting the gray level display voltage that was selected and outputted from the gray level display voltages; and suspending generation of a non-selected one of the gray level display voltages, said detecting step including a first setting step of forcibly setting a first voltage level for an input side of the switch, and a second setting step of changing the input side of the switch to a second voltage level when selected, so that the voltage level on the input side of the switch takes different values when selected and not selected in the selecting step.

8. The driving method as set forth in claim 7, wherein, in the detecting step, buffer means that corresponds to a non-selected gray level display voltage is turned off.

9. A display device driver, comprising:

a generator for generating a plurality of gray level display voltages;

a selector for selecting and outputting one of the plurality of gray level display voltages according to display data; and a detector for detecting the gray level display voltage that was selected and outputted by the selector from the plurality of gray level display voltages, so as to control the generator, the detector including a first voltage setting section provided on an input side of the selector, and a second voltage setting section provided on an output side of the selector.

10. A display device, comprising:

a display device driver; and a display panel, which is driven by the display device driver to display gray levels, said display device driver including:

generating means for generating a plurality of gray level display voltages;

selecting means for selecting and outputting one of the plurality of gray level display voltages according to display data; and detecting means for detecting the gray level display voltage that was selected and outputted by the selecting means from the plurality of gray level display voltages, so as to control the generating means, the detecting means including first voltage setting means provided on an input side of the selecting means, and second voltage setting means provided on an output side of the selecting means.

* * * * *